US011112119B2

(12) United States Patent
Hock

(10) Patent No.: US 11,112,119 B2
(45) Date of Patent: Sep. 7, 2021

(54) COMBUSTOR ASSEMBLY FOR A TURBO MACHINE

(71) Applicant: General Electric Company, Schenectady, NY (US)

(72) Inventor: Mackenzie Christopher Hock, Mason, OH (US)

(73) Assignee: General Electric Company, Schenectady, NY (US)

( * ) Notice: Subject to any disclaimer, the term of this patent is extended or adjusted under 35 U.S.C. 154(b) by 192 days.

(21) Appl. No.: 16/170,305

(22) Filed: Oct. 25, 2018

(65) Prior Publication Data

US 2020/0132306 A1 Apr. 30, 2020

(51) Int. Cl.
*F23R 3/54* (2006.01)
*F23R 3/00* (2006.01)

(52) U.S. Cl.
CPC ..... *F23R 3/54* (2013.01); *F23R 3/002* (2013.01)

(58) Field of Classification Search
CPC ..... F23R 3/54; F23R 3/52; F02C 3/145
See application file for complete search history.

(56) References Cited

U.S. PATENT DOCUMENTS 3,546,880 A * 12/1970 Schwaar ..... F04D 19/024 60/792
3,952,504 A * 4/1976 Sedgwick ..... F23R 3/007 60/753
4,203,283 A 5/1980 Weiler
4,586,328 A * 5/1986 Howald ..... F23R 3/34 60/794
6,079,199 A 6/2000 McCaldon et al.
8,001,793 B2 8/2011 Patel et al.
8,794,005 B2 8/2014 Rudrapatna et al.
8,864,492 B2 * 10/2014 Shi ..... F23R 3/54 431/253
9,400,110 B2 7/2016 Dudebout et al.
9,423,130 B2 8/2016 Prociw et al.
2002/0069648 A1 * 6/2002 Levy ..... F23C 9/006 60/804
2010/0257864 A1 10/2010 Prociw et al.
2011/0309187 A1 * 12/2011 Dev ..... F02C 3/067 244/36
2012/0328366 A1 12/2012 Jarmon et al.
2012/0328996 A1 12/2012 Shi et al.
(Continued)

FOREIGN PATENT DOCUMENTS

CN 85101392 A 10/1986
CN 101012937 A 8/2007

OTHER PUBLICATIONS

Combined Chinese Office Action and Search Report Corresponding to Application No. 2001911023493 dated Dec. 16, 2020.

*Primary Examiner* — Ehud Gartenberg
*Assistant Examiner* — Jacek Lisowski
(74) *Attorney, Agent, or Firm* — Dority & Manning, P.A.

(57) ABSTRACT

A turbo machine including an annular liner assembly defining a reverse flow combustion chamber is generally provided. The liner assembly includes a first piece defining an inner diameter (ID) combustor inlet portion, an outer diameter (OD) combustor outlet portion, and an outer diameter turbine shroud portion, in which the first piece defines a substantially solid volume between the inner diameter combustor inlet portion and the outer diameter combustor outlet portion.

20 Claims, 2 Drawing Sheets

(56) References Cited

U.S. PATENT DOCUMENTS

| | | | | |
|---|---|---|---|---|
| 2015/0239046 | A1* | 8/2015 | McMahan | B33Y 10/00 428/548 |
| 2017/0159487 | A1* | 6/2017 | Stapleton | F01D 25/12 |
| 2017/0248312 | A1* | 8/2017 | Hannwacker | F23R 3/50 |
| 2017/0363295 | A1 | 12/2017 | Stastny et al. | |
| 2017/0363296 | A1 | 12/2017 | Stastny et al. | |

* cited by examiner

COMBUSTOR ASSEMBLY FOR A TURBO MACHINE

FIELD

The present subject matter relates generally to hot gas path structures for combustor and turbine assemblies for turbo machines.

BACKGROUND

Various turbo machines, such as gas turbine engines, include combustor assemblies with reverse flow combustor assemblies in which flow through the combustion section. Generally, turbo machine designers and manufacturers are challenged to reduce part counts, weight, and size to improve turbo machine efficiency, performance, and cost. As such, there is a need for a turbo machine that improves turbo machine efficiency, performance, and cost through improved combustor and turbine structures.

BRIEF DESCRIPTION

Aspects and advantages of the invention will be set forth in part in the following description, or may be obvious from the description, or may be learned through practice of the invention.

A turbo machine including an annular liner assembly defining a reverse flow combustion chamber is generally provided. The liner assembly includes a first piece defining an inner diameter (ID) combustor inlet portion, an outer diameter (OD) combustor outlet portion, and an outer diameter turbine shroud portion, in which the first piece defines a substantially solid volume between the inner diameter combustor inlet portion and the outer diameter combustor outlet portion.

In various embodiments, the first piece is a single unitary piece defined from the ID combustor inlet portion to the OD combustor outlet portion and the OD turbine shroud portion.

In one embodiment, the turbine shroud portion is extended over at least a first turbine blade of a turbine section of the turbo machine. In another embodiment, the OD turbine shroud portion of the first piece extended over the first turbine blade is defined directly radially inward of the ID combustor inlet portion.

In still another embodiment, a primary combustion zone is defined at the combustion chamber directly radially outward of the ID combustor inlet portion of the first piece. The primary combustion zone is defined directly radially outward of the OD turbine shroud portion extended over the first turbine blade.

In still yet another embodiment, a radial plane is defined from a deflector wall of a dome assembly. The OD turbine shroud portion of the first piece is extended at least to the radial plane over the first turbine blade.

In one embodiment, the annular liner assembly includes a ceramic matrix composite material. In various embodiments, the ceramic matrix composite material includes silicon carbide (SiC), silicon, silica, or alumina matrix materials, or combinations thereof.

In one embodiment, approximately 95% or greater of a volume of the first piece between the ID combustor inlet portion and the OD combustor outlet portion is solid.

In various embodiments, a radius is defined at the first piece between the ID combustor inlet portion and the OD combustor outlet portion. In one embodiment, a volume of the first piece between the ID combustor inlet portion and the OD combustor outlet portion is equal to or less than the radius defined at the first piece.

In still various embodiments, the turbo machine further includes a nozzle assembly coupled to the annular liner assembly at the first piece OD combustor outlet portion. In one embodiment, the nozzle assembly is defined as a single structure integral to the first piece of the annular liner assembly. In another embodiment, the annular liner assembly further includes one or more vane assemblies disposed downstream of the nozzle assembly. The one or more vane assemblies is coupled as a single structure integral to the first piece of the annular liner assembly.

Another aspect of the present disclosure is directed to a gas generator for a gas turbine engine. The gas generator includes a composite annular liner assembly defining a reverse flow combustion chamber therewithin. The liner assembly includes a first piece defining an inner diameter (ID) combustor inlet portion, an outer diameter (OD) combustor outlet portion, and an outer diameter turbine shroud portion together formed integrally. Approximately 95% or greater of a volume of the first piece between the ID combustor inlet portion and the OD combustor outlet portion is solid.

In one embodiment, the first piece is a single unitary piece defined from the ID combustor inlet portion to the OD combustor outlet portion and the OD turbine shroud portion.

In another embodiment, the gas generator further includes a dome assembly including a deflector wall. A radial plane is defined from the deflector wall, and the ID combustor inlet portion of the first piece is defined from the radial plane to a radius defined at the first piece of the liner assembly.

In still another embodiment, the OD turbine shroud portion of the first piece is defined radially inward of the ID combustor inlet portion of the first piece.

In still yet another embodiment, a primary combustion zone is defined at the combustion chamber between the first piece and a second piece of the liner assembly. The primary combustion zone is defined directly radially between the first piece and the second piece of the liner assembly between the radius of the first piece and the deflector wall of the dome assembly.

In yet another embodiment, the OD turbine shroud portion of the first piece is extended over a first turbine blade.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
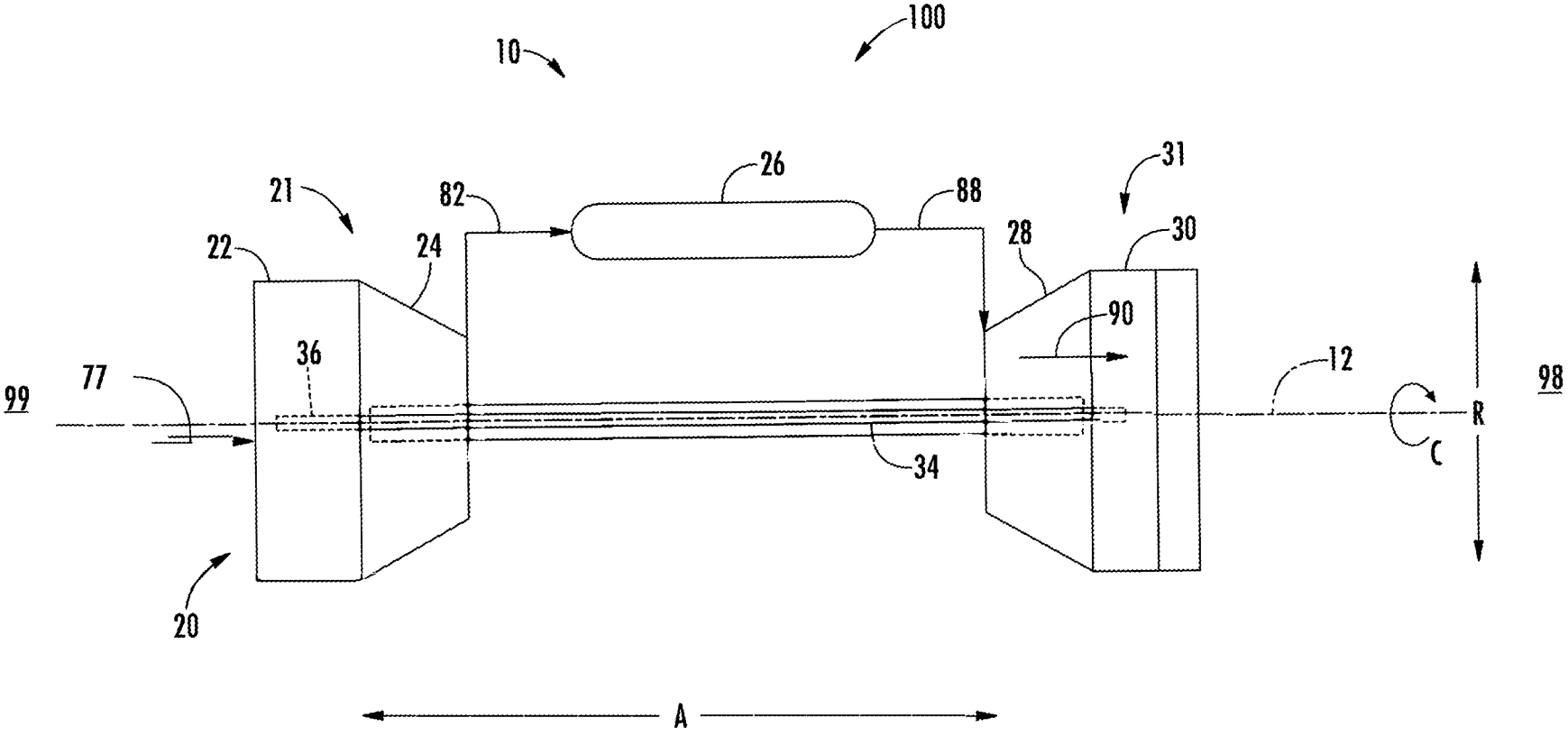
FIG. 1 is a schematic, cross-sectional view of an exemplary embodiment of a turbo machine engine according to various embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Embodiments of turbo machines including gas generator assemblies that may improve turbo machine performance and efficiency via reduced part counts, weight, and size are generally provided. The embodiments generally provided herein provide a substantially integrated combustor flowpath and turbine flowpath structure such as to reduce a quantity of fasteners or attaching structures or attaching methods used therebetween. The embodiments generally provided herein may further reduce or eliminate a flow of cooling air through at least a portion of the liner assembly, thereby improving efficiency and performance of the turbo machine and gas generator.

Referring now to the drawings, FIG. 1 is a schematic partially cross-sectioned side view of an exemplary turbo machine 10 herein referred to as "engine 10" as may incorporate various embodiments of the present disclosure. Although further described below with reference generally to a gas turbine engine, the present disclosure is also applicable to turbomachinery in general, including marine and industrial gas turbine engines, auxiliary power units, and gas turbine engine cores for turbofan, turbojet, turboprop, and turboshaft gas turbine engines.

As shown in FIG. 1, the engine 10 has a longitudinal or axial centerline axis 12 that extends there through for reference purposes. The engine 10 defines an axial direction A and an upstream end 99 and a downstream end 98. The upstream end 99 generally corresponds to an end of the engine 10 from which air enters the engine 10 and the downstream end 98 generally corresponds to an end at which air exits the engine 10 generally opposite of the upstream end 99. A reference axial direction A is defined co-directional to an axial centerline 12 of the engine 10. A reference radial direction R is extended perpendicular to the axial direction A from the axial centerline 10.

The engine 10 includes a gas generator 100 that may generally include a substantially tubular outer casing that defines an annular inlet 20. The outer casing generally encases or at least partially forms, in serial flow relationship, a compressor section 21 having a booster or low pressure (LP) compressor 22, a high pressure (HP) compressor 24, a combustion section 26, and a turbine section 31 including a high pressure (HP) turbine 28, and a low pressure (LP) turbine 30. A high pressure (HP) rotor shaft 34 generally drivingly connects the HP turbine 28 to the HP compressor 24. A low pressure (LP) rotor shaft 36 generally drivingly connects the LP turbine 30 to the LP compressor 22.

However, it should be appreciated that in other embodiments, the LP compressor 22 may further include a fan or propeller assembly attached thereto. In still other embodiments not depicted, the engine 10 may include an intermediate spool including an intermediate pressure compressor disposed between the LP compressor 22 and the HP compressor, and an intermediate pressure turbine disposed between the HP turbine 28 and the LP turbine 30. In yet other embodiments not depicted, the engine 10 may include a free turbine aerodynamically coupled to the gas generator 100.

A flow of air enters the engine 10 through the inlet 20, such as shown schematically via arrows 77. The flow of air 77 is increasingly compressed through the compressor section 21 to produce compressed air at the combustion section 26, such as shown schematically via arrows 82. The compressed air 82 flows into the combustion section 26 and is mixed with a liquid and/or gaseous fuel to produce combustion gases 88, such as further shown and described in regard to FIG. 2. The combustion gases 88 then flow into the turbine section 31 and expanded to drive the compressor section 21 via the shafts 34, 36 coupled rotatably to respective compressors 22, 24.

Figure 2:
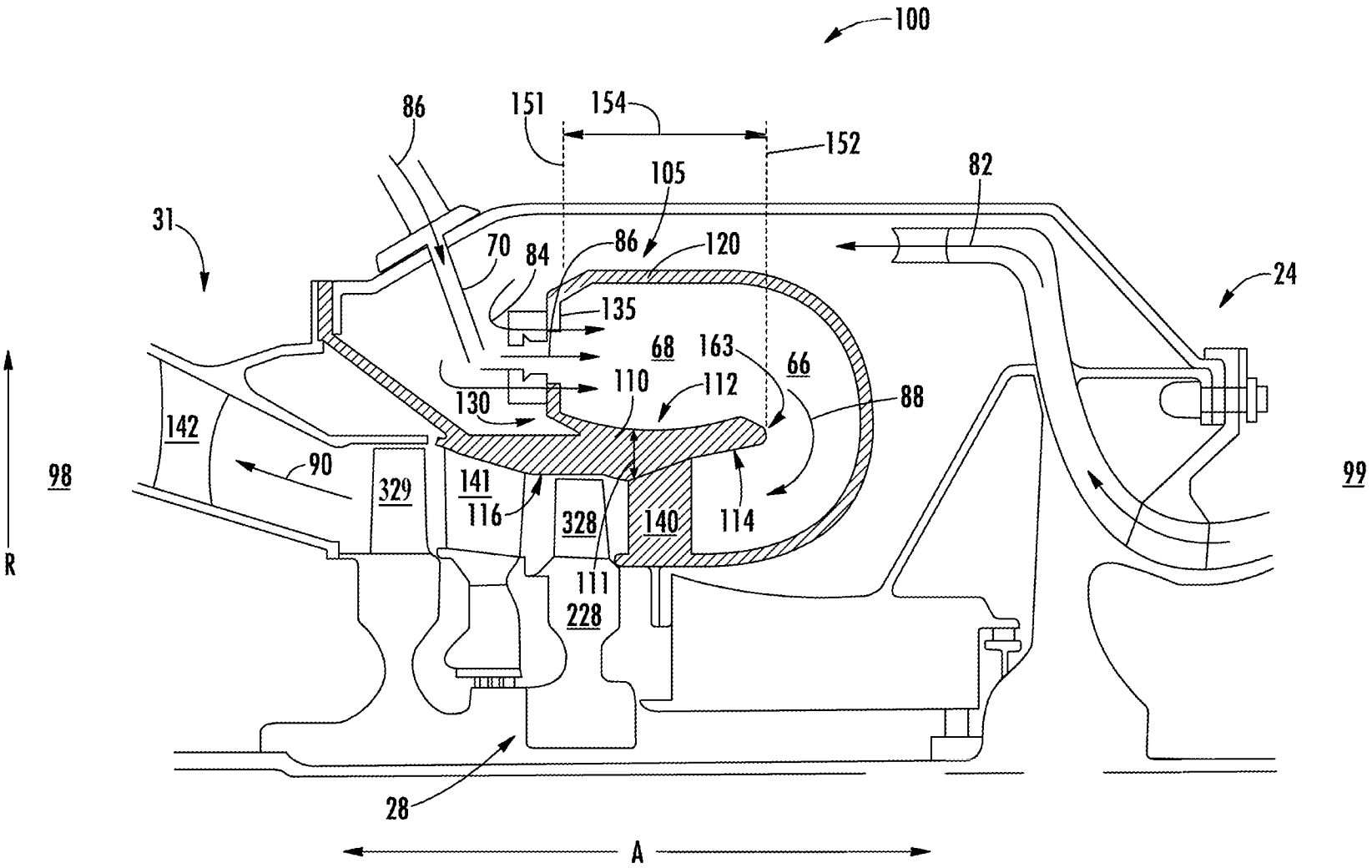
FIG. 2 is a schematic, cross-sectional view of an exemplary embodiment of a portion of a gas generator of the turbo machine depicted in regard to FIG. 1.

Referring now to FIG. 2, a schematic cross sectional view of an exemplary embodiment of a portion of a gas generator 100 is generally provided. The gas generator 100 generally includes at least a portion of the compressor section 21 (FIG. 1), such as the HP compressor 24, the combustion section 26, and at least a portion of the turbine section 31 (FIG. 1), such as the HP turbine 28. The gas generator 100 includes the combustion section 26 defining a reverse flow combustion section. For example, a flow of compressed air, shown schematically by arrows 82, exits the compressor section 21 generally along an axial first direction. The flow of air entering a combustion chamber 66, shown schematically by arrows 84, turns substantially 180 degrees from the axial first direction of the flow of air 82 to an axial second direction (i.e., opposite of the axial first direction) as the flow of air 84 enters the combustion chamber 66. The flow of air 84 entering the combustion chamber 66 mixes with a flow of liquid and/or gaseous fuel, shown schematically by arrows 86, from a fuel injector 70. The flow of air 84 mixed with the flow of fuel 86 together mix and are combusted (or in other embodiments, detonated) to produce combustion gases, such as shown schematically by arrows 88. The flow of combustion gases 88 turn substantially 180 degrees to flow in the axial first direction through the HP turbine 28, such as shown schematically by arrows 90.

The combustor assembly 26 of the gas generator 100 includes an annular liner assembly 105 defining the reverse flow combustion chamber 66. The liner assembly 105 includes a first piece 110 and a second piece 120 together forming the combustion chamber 66 therebetween. For example, the first piece 110 and the second piece 120 each define a liner of the liner assembly 105. The liner assembly 105 is formed at least partially or entirely of ceramic matrix composite (CMC) materials.

Exemplary CMC materials may include silicon carbide (SiC), silicon, silica, or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAIV-IIC®), alumina silicates (e.g., Nextel's 440 and 480), and chopped whiskers and fibers (e.g., Nextel's 440 and SAF-FIL®), and optionally ceramic particles (e.g., oxides of Si, Al, Zr, Y, and combinations thereof) and inorganic fillers (e.g., pyrophyllite, wollastonite, mica, talc, kyanite, and montmorillonite). For example, in certain embodiments, bundles of the fibers, which may include a ceramic refractory material coating, are formed as a reinforced tape, such as a unidirectional reinforced tape. A plurality of the tapes may be laid up together (e.g., as plies) to form a preform component. The bundles of fibers may be impregnated with a slurry composition prior to forming the preform or after formation of the preform. The preform may then undergo thermal processing, such as a cure or burn-out to yield a high char residue in the preform, and subsequent chemical processing, such as melt-infiltration with silicon, to arrive at a component formed of a CMC material having a desired chemical composition. In other embodiments, the CMC material may be formed as, e.g., a carbon fiber cloth rather than as a tape.

Referring still to FIG. 2, the first piece 110 of the liner assembly 105 defines an inner diameter (ID) combustor inlet portion 112, an outer diameter (OD) combustor outlet portion 114, and an outer diameter (OD) turbine shroud portion 116. In various embodiments, the first piece 110 defines a substantially solid volume 111 between the ID combustor inlet portion 112 and the OD combustor outlet portion 114. In one embodiment, approximately 95% to approximately 100% of the volume 111 of the first piece 110 between the ID combustor inlet portion 112 and the OD combustor outlet portion 114 is solid. In another embodiment, approximately 97% to approximately 100% of the volume 111 of the first piece 110 is solid. In yet another embodiment, approximately 99% to approximately 100% of the volume 111 of the first piece 110 is solid. In still yet another embodiment, approximately 100% of the volume 111 of the first piece 110 is solid. In various embodiments, approximately 0% to approximately 5% of the volume 111 of the first piece 110 is porous or otherwise defines voids in the volume 111. In one embodiment, approximately 0% to approximately 3% of the volume 111 of the first piece 110 is porous. In another embodiment, approximately 0% to approximately 1% of the volume 111 of the first piece 110 is porous. In still yet another embodiment, approximately 0% of the volume 111 of the first piece 110 is porous.

In still various embodiments, the substantially solid volume 111 of the first piece 110 is between the ID combustor inlet portion 112, the OD combustor outlet portion 114, a radius 163 at which the combustor flowpath turns (defined further below), and along a plane corresponding to a nozzle assembly 140, or one or more vane assemblies 141, 142, such as further described below. As such, the substantially solid volume 111 between the ID combustor inlet portion 112 and the OD combustor outlet portion 114 of the first piece 110 reduces the thermal gradient, thereby improving combustor assembly 26 and gas generator 100 performance.

The first piece 110 including a CMC material enables defining the ID combustor inlet portion 112 and the OD combustor outlet portion 114 of the first piece 110 as a substantially single unitary piece, of which the two sides of the unitary piece each compose part of the continuous flowpath. For example, the CMC material enables a reduced temperature gradient through the substantially solid volume 111 of the first piece 110 such as to reduce an amount of cooling flow therethrough, in contrast to defining cavities, passages, spaces, or a separation between the ID combustor inlet portion 112 and the OD combustor outlet portion 114. In one embodiment, the first piece 110 further defines a single unitary piece further through the OD turbine shroud portion 116, the OD combustor outlet portion 114, and the ID combustor inlet portion 112. As such, the first piece 110 of the liner assembly 105 may enable a particularly improved combustor assembly 26 and gas generator 100, such as via reducing or eliminating cooling air through the first piece 110, or reducing radial dimensions or volume (e.g., along the radial direction, circumferential direction, and axial direction), thereby reducing gas generator 100 and engine 10 size and weight and improving efficiency and performance.

It should be appreciated that in various embodiments the OD turbine shroud portion 116 defines a portion at the HP turbine 28 extended substantially around a first turbine rotor 228 including a first turbine blade 328 attached thereto. The first turbine rotor 228 is disposed downstream of the combustion chamber 66 of the combustor assembly 26. In one embodiment, the first turbine rotor 228 is disposed in direct downstream flow arrangement (i.e., adjacent to) a first turbine vane or nozzle assembly 140. The nozzle assembly 140 is disposed at the liner assembly 105 between the first piece 110 and the second piece 120 at the OD combustor outlet portion 114. In one embodiment, the nozzle assembly 140 is defined as a single structure integral to the first piece 110 of the liner assembly 105. For example, the nozzle assembly 140 may be attached to the first piece 110 of the nozzle assembly 140 as a single unitary structure.

In various embodiments, the first piece 110 may further extend downstream of the nozzle assembly 140 such as to further include an intermediate vane assembly 141 of the turbine section 31. As depicted in regard to FIG. 2, the intermediate vane assembly 141 is disposed downstream of the nozzle assembly 140 and the first turbine blade 328. Still further, the intermediate vane assembly 141 is disposed between, relative to flow arrangement, the first turbine blade 328 and a second turbine blade 329. It should be appreciated that in various embodiments the gas generator 100 may include a plurality of second turbine blade 329 rows downstream of the first turbine blade 328 assembly (e.g., a third stage, a fourth stage, etc., of the turbine section 31) and intermediate vane assemblies 141 disposed between each pair of second turbine blade rows.

In still another embodiment, the first piece 110 may further extend downstream of the nozzle assembly 140 such as to further include an exit vane assembly 142 of the turbine section 31. As depicted in regard to FIG. 2, the exit vane assembly 142 is disposed downstream of the second turbine blade 329. It should be appreciated that in various embodiments the exit vane assembly 142 may define an inlet vane assembly of a downstream turbine rotor assembly (e.g., an inlet vane assembly of a low pressure turbine).

It should be appreciated that in various embodiments, the OD turbine shroud portion 116 extends partially or entirely OD of the turbine blades (e.g., turbine blades 328, 329) of the turbine section 31 as a single, unitary structure such as to improve gas generator 100 performance and operation. Such performance and operation improvements include, but are not limited to, improve thermal efficiency such as to reduce or eliminate substantially cooling openings therethrough, or to reduce or eliminate a flow of cooling fluid provided thereto (e.g., from the compressor section 21). Still further, such performance and operation improvements may include decreasing weight and complexity of the gas generator 100, thereby improving thrust output and specific fuel consumption.

Referring still to FIG. 2, the combustion section 26 includes a dome assembly 130 defined at an upstream end of the liner assembly 105. The dome assembly 130 may include a swirler assembly (not depicted) through which the flow of air 84 entering the combustion chamber 66 through the dome assembly 130 is conditioned as the flow of air 84 mixes with the flow of fuel 86. The dome assembly 130 may generally include a deflector wall 135 extended between the first piece 110 and the second piece 120 of the liner assembly 105. The deflector wall 135 may generally define a heat shield between the combustion chamber 66 downstream of the deflector wall and a generally colder diffuser cavity upstream of the deflector wall 135.

A radial plane 151 is defined along the radial direction R from the deflector wall 135. In various embodiments, the OD turbine shroud portion 116 of the first piece 110 is extended at least to the radial plane 151 over the first turbine blade 328. For example, the OD turbine shroud portion 116 is extended substantially over the first turbine blade 328 over a leading edge and a trailing edge thereof.

In still various embodiments, a radius 163 is defined at the first piece 110 between the ID combustor inlet portion 112 and the OD combustor outlet portion 114. In one embodiment, the volume 111 of the first piece 110 between the ID combustor inlet portion 112 and the OD combustor outlet portion 114 is equal to or less than the radius 163 defined at the first piece 110. As such, the first piece 110 of the liner assembly 105 may define a substantially solid unitary piece between the ID combustor inlet portion 112 and the OD combustor outlet portion 114. In various embodiments, the ID combustor inlet portion 112 of the first piece 110 is defined from the radial plane 151 to the radius 163. In one embodiment, the OD turbine shroud portion 116 of the first piece 110 is defined directly radially inward of the ID combustor inlet portion 112.

Referring still to FIG. 2, in various embodiments, the combustion chamber 66 includes a primary combustion zone 68 defined directly outward along the radial direction R of the ID combustor inlet portion 112 of the first piece 110. In still various embodiments, the primary combustion zone 68 is defined directly outward along the radial direction R of the OD turbine shroud portion 116 extended over the first turbine blade 328. For example, in one embodiment, the primary combustion zone 68, the ID combustor inlet portion 112, and the OD combustor outlet portion 114 are defined between the radial plane 151 and a reference radial plane 152 from the radius 163 extended along the radial direction R, such as depicted along area 154. In one embodiment, the primary combustion zone 68 is defined at the combustion chamber 66 between the first piece 110 and the second piece 120 along the radial direction R. In various embodiments, the primary combustion zone 68 is further defined between the deflector wall 135 and the radius 163 or reference radial plane 152 extended therefrom. As such, the combustor assembly 26 provides a substantially compact arrangement while further providing thermal efficiency improvements via the single, unitary first piece 110. Still further, the combustor assembly 26 may provide a substantially compact and efficient arrangement while decreasing cooling requirements at OD turbine shroud portion 116 of the unitary first piece 110, thereby improving overall gas generator 100 and engine 10 performance.

It should be appreciated that the primary combustion zone 68 may generally define a portion of the combustion chamber 66 at which the flow of air 84 and fuel 86 is mixed and burned to produce combustion gases 88. It various embodiments, the combustion section 26 may define a lean burn combustor in which the fuel/air mixture at the primary combustion zone 68 is mixed and burn to produce a higher or generally rich fuel/air ratio at the primary combustion zone 68 compared to the overall combustor fuel/air ratio. For example, the first piece 110, the second piece 120, or both, may include orifices or dilution openings to admit additional air into the combustion chamber 66 (e.g., downstream of the primary combustion zone 68) to complete the combustion process and dilute or quench the combustion gases 88 to a desired fuel/air ratio and temperature at nozzle assembly 140 and/or first turbine rotor 228, and in consideration of a desired emissions output. However, it should be appreciated that the combustion section 26 may define any one of rich burn, lean burn, or combination combustion processes, and combustor assemblies associated therewith.

At least a portion of the gas generator 100 may be manufactured by one or more processes or methods known in the art, such as, but not limited to, machining processes, additive manufacturing, layups, casting, or combinations thereof. The combustion section 26 may include any suitable material for a combustor assembly 118 for a turbine engine 10, such as, but not limited to, iron and iron-based alloys, steel and stainless steel alloys, nickel and cobalt-based alloys, or titanium and titanium-based alloys, except as otherwise described herein. Various portions of the gas generator 100 and the engine 10 may include one or more structures or methods for fastening or otherwise adhering portions, elements, or components described herein together, although such fasteners may not be depicted herein. Such structures and methods may include, but are not limited to, bolts, nuts, tie rods, screws, pins, etc., or one or more bonding processes, including, but not limited to, welding, brazing, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbo machine, the turbo machine defining a radial direction, the turbo machine comprising:

an annular liner assembly defining a reverse flow combustion chamber therewithin, the liner assembly comprising a first piece and a second piece, the first piece defining an inner diameter (ID) combustor inlet portion, an outer diameter (OD) combustor outlet portion, and an outer diameter (OD) turbine shroud portion, wherein the first piece defines a substantially solid volume between the ID combustor inlet portion and the OD combustor outlet portion, the annular liner assembly further comprising a dome assembly and a deflector wall of the dome assembly, the deflector wall positioned at an inlet of the dome assembly of the annular liner assembly, the deflector wall extending along the radial direction between the first piece and the second piece, and the deflector wall aligned along the radial direction with at least a portion of a first turbine blade.

2. The turbo machine of claim 1, wherein the first piece is a single unitary piece defined from the ID combustor inlet portion to the OD combustor outlet portion and the OD turbine shroud portion.

3. The turbo machine of claim 2, wherein the OD turbine shroud portion is extended over at least the first turbine blade of a turbine section of the turbo machine.

4. The turbo machine of claim 3, wherein the OD turbine shroud portion of the first piece extended over at least the first turbine blade is defined directly inward in the radial direction of the ID combustor inlet portion.

5. The turbo machine of claim 3, wherein a primary combustion zone is defined at the combustion chamber directly outward in the radial direction of the ID combustor inlet portion of the first piece, and wherein the primary combustion zone is defined directly outward in the radial direction of the OD turbine shroud portion extended over at least the first turbine blade.

6. The turbo machine of claim 3, wherein a radial plane is defined from the deflector wall of the dome assembly, and wherein the OD turbine shroud portion of the first piece is extended at least to the radial plane over the first turbine blade.

7. The turbo machine of claim 1, wherein the annular liner assembly comprises a ceramic matrix composite material.

8. The turbo machine of claim 7, wherein the ceramic matrix composite material comprises silicon carbide (SiC), silicon, silica, or alumina matrix materials, or combinations thereof.

9. The turbo machine of claim 1, wherein the substantially solid volume is approximately 95% or greater solid between the ID combustor inlet portion and the OD combustor outlet portion.

10. The turbo machine of claim 1, wherein a radius is defined at the first piece between the ID combustor inlet portion and the OD combustor outlet portion.

11. The turbo machine of claim 10, wherein a volume of the first piece between the ID combustor inlet portion and the OD combustor outlet portion is equal to or less than the radius defined at the first piece.

12. The turbo machine of claim 1, further comprising:

a nozzle assembly coupled to the annular liner assembly at the first piece OD combustor outlet portion.

13. The turbo machine of claim 12, wherein the nozzle assembly is defined as a single structure integral to the first piece of the annular liner assembly.

14. The turbo machine of claim 12, wherein the annular liner assembly further comprises:

a vane assembly disposed downstream of the nozzle assembly, wherein the vane assembly is coupled to the first piece of the annular liner assembly.

15. A gas generator for a gas turbine engine defining a radial direction, the gas generator comprising:

an annular liner assembly defining a reverse flow combustion chamber therewithin, the annular liner assembly comprising a first piece and a second piece, the first piece defining an inner diameter (ID) combustor inlet portion, an outer diameter (OD) combustor outlet portion, and an outer diameter (OD) turbine shroud portion together formed integrally, wherein the first piece is approximately 95% or greater of a solid volume of a ceramic matrix composite material between the ID combustor inlet portion and the OD combustor outlet portion, the annular liner assembly further comprising a dome assembly and a deflector wall of the dome assembly, the deflector wall positioned at an inlet of the dome assembly of the annular liner assembly, the defector wall extending along the radial direction between the first piece and the second piece, and the deflector wall aligned along the radial direction with at least a portion of a first turbine blade.

16. The gas generator of claim 15, wherein the first piece is a single unitary piece forming the ID combustor inlet portion to the OD combustor outlet portion and the OD turbine shroud portion.

17. The gas generator of claim 16, wherein a radial plane is defined from the deflector wall, and wherein the ID combustor inlet portion of the first piece is defined from the radial plane to a radius defined at the first piece of the annular liner assembly.

18. The gas generator of claim 17, wherein the OD turbine shroud portion of the first piece is defined inward in the radial direction of the ID combustor inlet portion of the first piece.

19. The gas generator of claim 18, wherein a primary combustion zone is defined at the combustion chamber between the first piece and a second piece of the annular liner assembly, and wherein the primary combustion zone is defined, in the radial direction, directly between the first piece and the second piece of the annular liner assembly between the radius of the first piece and the deflector wall of the dome assembly.

20. The gas generator of claim 18, wherein the OD turbine shroud portion of the first piece is extended over the first turbine blade.

* * * * *